US006369553B1

(12) United States Patent
Davis

(10) Patent No.: US 6,369,553 B1
(45) Date of Patent: Apr. 9, 2002

(54) METHOD AND AN APPARATUS FOR ADJUSTING VOLTAGE FROM A SOURCE

(75) Inventor: Jeffrey B. Davis, El Dorado Hills, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/539,374

(22) Filed: Mar. 31, 2000

(51) Int. Cl.[7] ..... G05F 1/40
(52) U.S. Cl. ..... 323/274; 327/544; 327/546
(58) Field of Search ..... 323/311–316, 299, 323/303, 273, 274; 327/540, 541, 544, 546; 307/130, 39, 66

(56) References Cited

U.S. PATENT DOCUMENTS 4,929,884 A * 5/1990 Bird et al. ..... 323/313
5,998,981 A * 12/1999 Houghton et al. ..... 323/282
6,028,374 A * 2/2000 Razak ..... 307/130
6,046,624 A * 4/2000 Nam et al. ..... 327/530
6,160,490 A * 12/2000 Pace et al. ..... 340/825.44

* cited by examiner

*Primary Examiner*—Peter S. Wong
*Assistant Examiner*—Gary L. Laxton
(74) *Attorney, Agent, or Firm*—Blakely, Sokoloff, Taylor & Zafman LLP

(57) ABSTRACT

An apparatus and a method for decreasing the voltage from a source. The apparatus includes a voltage reference source. The voltage reference source is coupled to a first transistor and to a decoupling capacitor. The first transistor is a negative-channel metal oxide ("NMOS") transistor which has an output voltage equal to a gate source voltage of the NMOS transistor minus an NMOS transistor threshold voltage.

27 Claims, 11 Drawing Sheets

METHOD AND AN APPARATUS FOR ADJUSTING VOLTAGE FROM A SOURCE

BACKGROUND OF THE INVENTION

1. Field of the Invention

The invention relates generally to a circuit that extends the life of a power source, and more specifically to a circuit that affects the voltage from a power source.

2. Description of Related Art

Power sources such as batteries or capacitors are used in a variety of devices to ensure that when a device such as a computer is disconnected from its primary power supply, the battery is configured to provide a certain amount of voltage to the computer in order to maintain a basic computation operation and preserve data on the computer. However, devices such as computers have evolved such that voltage from a standard battery may be too high for safe operation of certain devices used in the construction of the computer. For example, batteries connected to an integrated circuit currently generate too much voltage causing the chemicals of the battery to deplete more quickly than is necessary. Accordingly, it is desirable to develop a circuit that overcomes the disadvantages associated with conventional circuits used with power sources.

BRIEF DESCRIPTION OF THE DRAWINGS

The features, aspects, and advantages of the invention will become more thoroughly apparent from the following detailed description, appended claims, and accompanying drawings in which:

DETAILED DESCRIPTION OF THE INVENTION

The following detailed description and the accompanying drawings are provided for the purpose of describing and illustrating presently preferred embodiments of the invention only, and are not intended to limit the scope of the invention in any way.

One embodiment of the invention relates to a circuit that has a voltage reference source that is coupled to a first transistor and a decoupling capacitor. This circuit allows the voltage reference source to provide a gate bias on the transistor causing a voltage drop at its output that is equivalent to its gate source ("$V_{GS}$") minus its threshold voltage. This reduces the voltage from a power source such as a battery to a voltage that is, for example, generally less than or equal to 2.0 volts.

Figure 1:
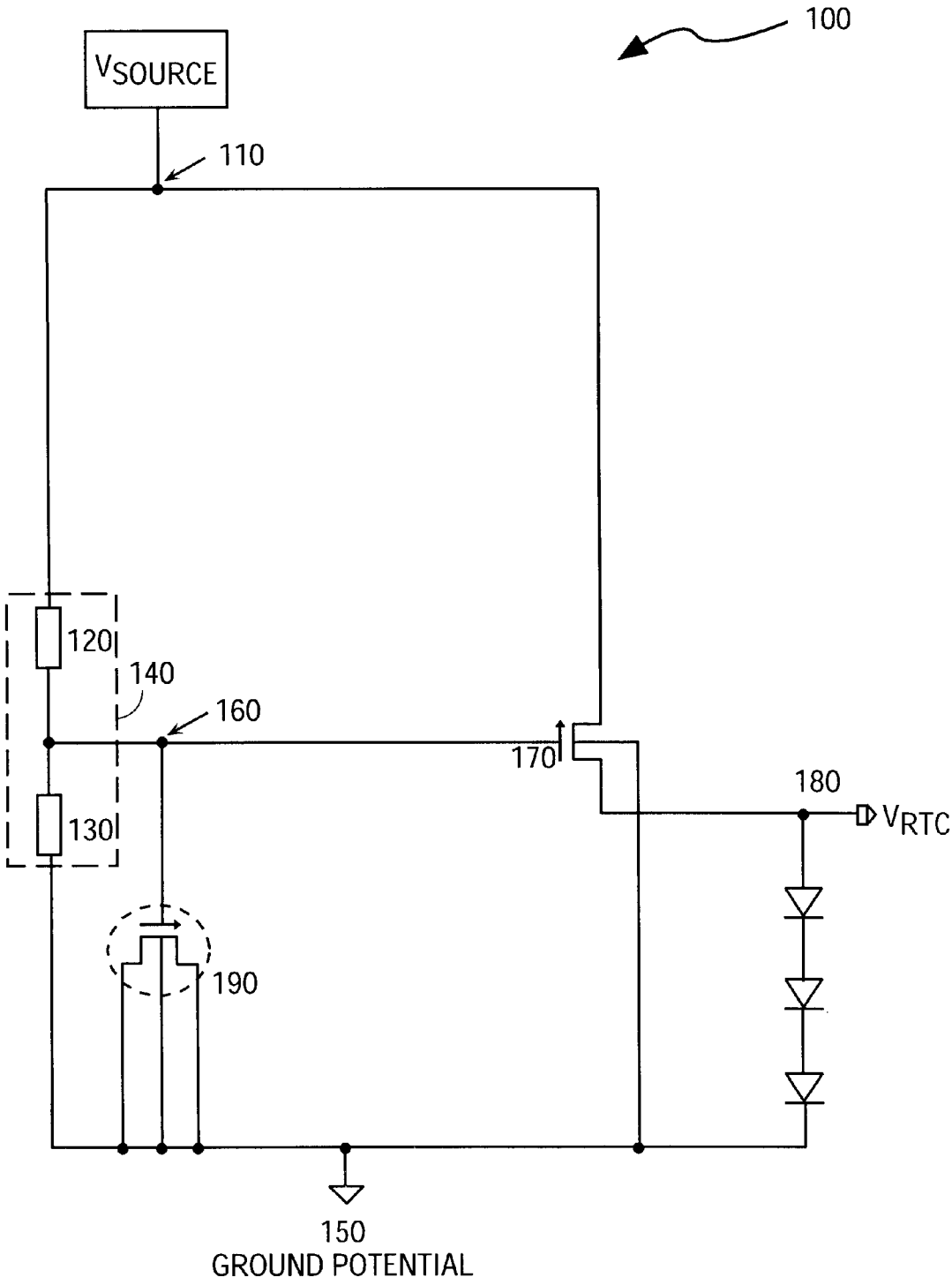
FIG. 1 illustrates a circuit in accordance with one embodiment of the invention.
Figure 3:
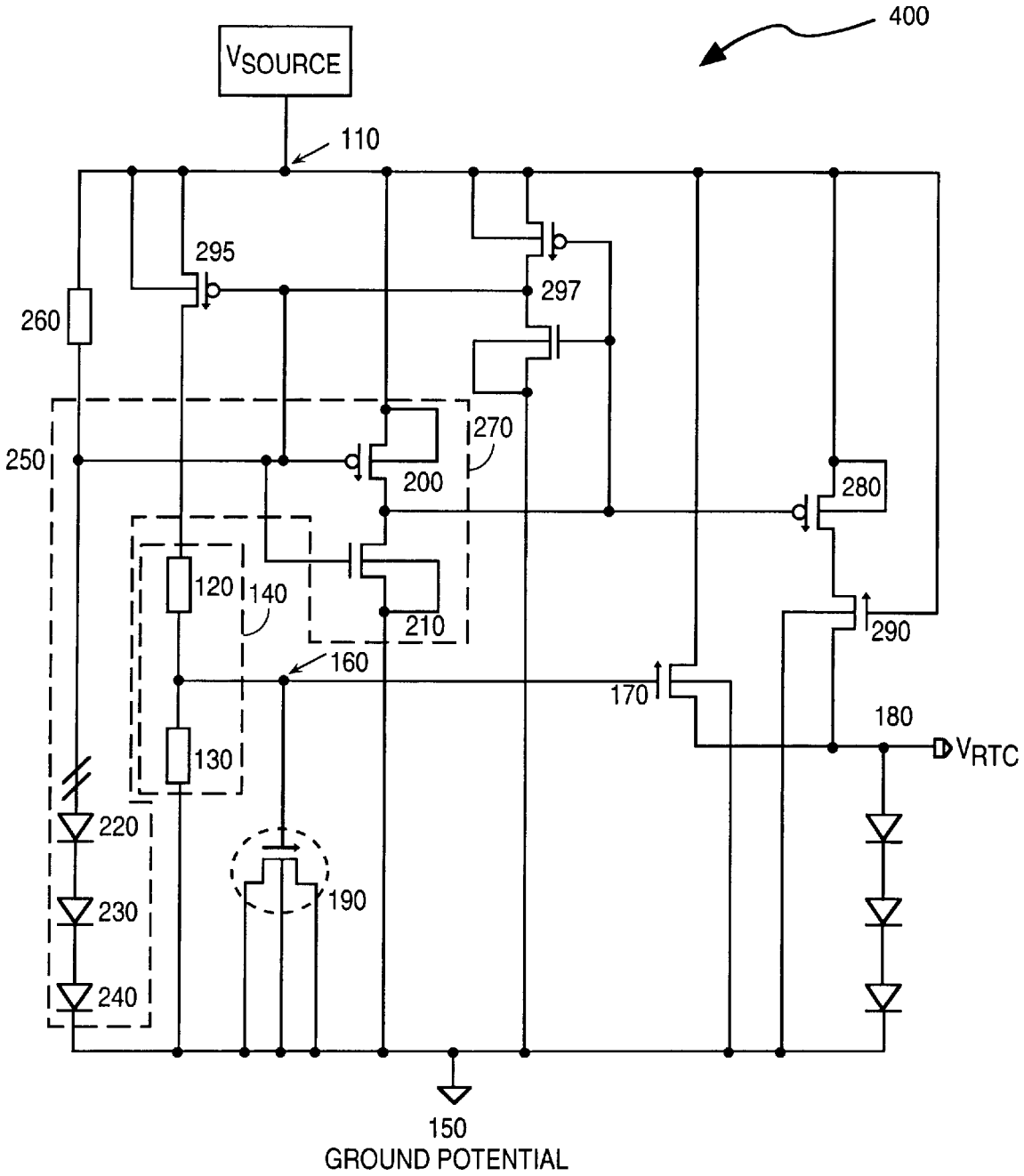
FIG. 3 illustrates a circuit in accordance with one embodiment of the invention.

In another embodiment of the invention, a monitoring circuit is coupled to the voltage reference source. The monitoring circuit monitors the voltage level for a power source such as a battery. The monitoring circuit, comprised of a second transistor and a third transistor, is designed to have switching point that is sensitized to the voltage level of a power source. The monitoring circuit is configured to detect whether the voltage of a power source is within a proper range. The voltage from a power source is within a proper range when the voltage requirements of a device are met and the useful life of consumption of chemicals in the power source such as a battery are minimized. If the power source voltage is within a proper range, the circuit illustrated in FIG. 1 is used. However, if the chemicals in the battery are partially spent or depleted too quickly, an alternate circuit illustrated in FIG. 3 is used.

FIG. 1 illustrates circuit 100 in accordance with one embodiment of the invention. Voltage source ("$V_{SOURCE}$") represents voltage from a power source such as a battery used, for example, to provide power to a device such as a computer. This allows the computer to retain its memory, the data in the memory, the configuration of the computer and other like information. $V_{SOURCE}$ may be implemented as one or more primary or secondary cells or a capacitor such as a lithium cell that generally has an output in the approximate range of 2.0 volts to 3.3 volts, a nickel-cadmium battery that generally has an output in the approximate range of 1.0 volts to 1.4 volts, nickel metal hydride in the approximate range of 1.15 volts to 1.40 volts, silver oxide in the approximate range of 1.5 volts to 1.6 volts, or other suitable batteries. Lithium batteries are preferred for their long shelf and operating life. The battery is typically coupled to the smallest components that are most sensitive to the high field strength that results from over voltage exposure of a circuit such as thin gate oxide metal-oxide semiconductor field-effect transistors. Charge from $V_{SOURCE}$ moves from the positive power supply through a voltage reference such as resistor divider 140. Resistor divider 140 is comprised of first resistor 120 and second resistor 130. Resistor divider 140 establishes a reference voltage that is fractionally between the voltage of $V_{SOURCE}$ and the ground potential voltage at node 150 which produces a voltage ("$V_{DIV}$") at the divider output node 160. $V_{DIV}$ is the voltage that is present at the gate terminal of negative-channel metal oxide semiconductor ("NMOS") transistor 170. The behavior of the NMOS transistor is such that its output voltage at node 180 is equal to the $V_{GS}$ at transistor 170 minus the threshold voltage of transistor 170.

Figure 2:
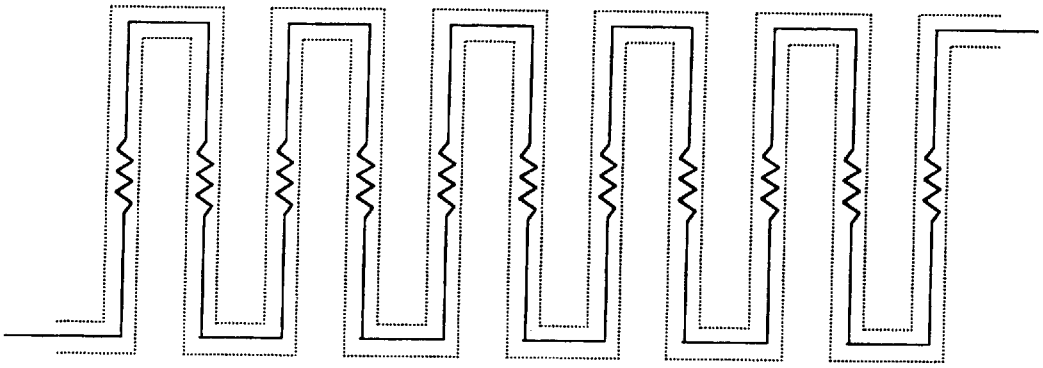
FIG. 2 illustrates resistors placed in a serpentine type fashion in accordance with one embodiment of the invention.

The resistor divider voltage at node 160 is set by $$V_{t170} = \frac{R_{130} \times V_{110}}{R_{130} + R_{120}},$$

the ratio of the resistance of first resistor 120 to the resistance of second resistor 130. $R_{120}$ and $R_{130}$ represent the resistance for first and second resistors (120, 130), respectively, and $V_{110}$ and $V_{t107}$ are the voltages at node 110 and the voltage at transistor 170, respectively. First and second resistors (120, 130) proportionally move resistor divider voltage at node 160 between $V_{SOURCE}$ and ground potential voltage at node 150. As a result, $V_{DIV}$ at node 160 may be changed by adjusting the resistance values of first resistor 120 and second resistor 130. This is accomplished by using particular resistive materials or modifying the layout of the resistors. For instance, the resistance of resistors (120, 130) may be adjusted by using passive resistance elements that include P+ diffusion, N+ diffusion, N-well, or unsalicided polysilicon. Moreover, the resistors may be designed to be long and thin, short and wide, or other like designs. It will also be appreciated that there are numerous ways to implement the layout of resistors to achieve a certain resistance. In order to produce the largest resistance for the smallest required area, the resistors may be laid out in a serpentine style as illustrated in FIG. 2. Resistors laid out in the serpentine style are subject to process variation in which the physical dimensions and chemical make-up of the resistors vary; therefore, resistors arranged in the serpentine style are generally not ideal for circuits that require precise resistor values. However, since the techniques of the invention use the ratio of the resistance of the first resistor 120 and the second resistor 130, the resistors are designed such that the first resistor 120 and the second resistor 130 are subjected to similar process variations and dimensional variances. This is accomplished by designing resistors (120, 130) with identical symmetry and x, y orientation. This allows the resistance value of the first resistor 120 and the resistance value of the second resistor 130 to track each other such that the resistance in ohms of each resistor increase and decrease together. For example, the resistance in first resistor 120 may be 1E6 ohms and the resistance in the second resistor may be 2E6 ohms. Since the resistance of the first resistor 120 and the second resistor 130 move together, the ratio of the first resistor 120 to the second will remain relatively fixed. The ratio $$\frac{R_{130} \times V_{DIV}}{R_{120} + R_{130}}$$

is set to=desired $V_{RTC}+V_{t170}$.

Figure 5:
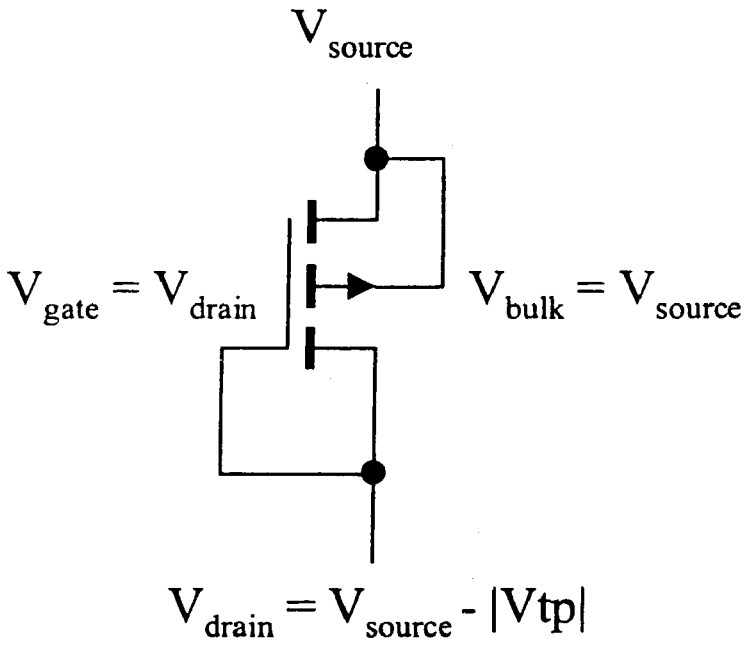
FIG. 5 illustrates the implementation of a diode connected pMOSFET in accordance with one embodiment of the invention.
Figure 6A:
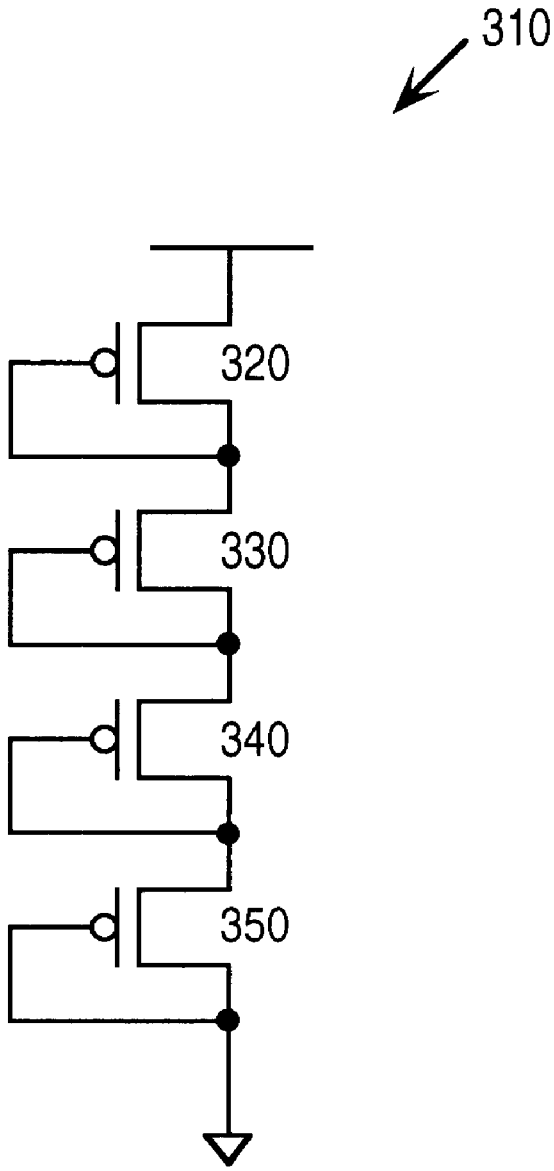
FIG. 6A illustrates the actual and functional implementation of transistors used in accordance with one embodiment of the invention.
Figure 6B:
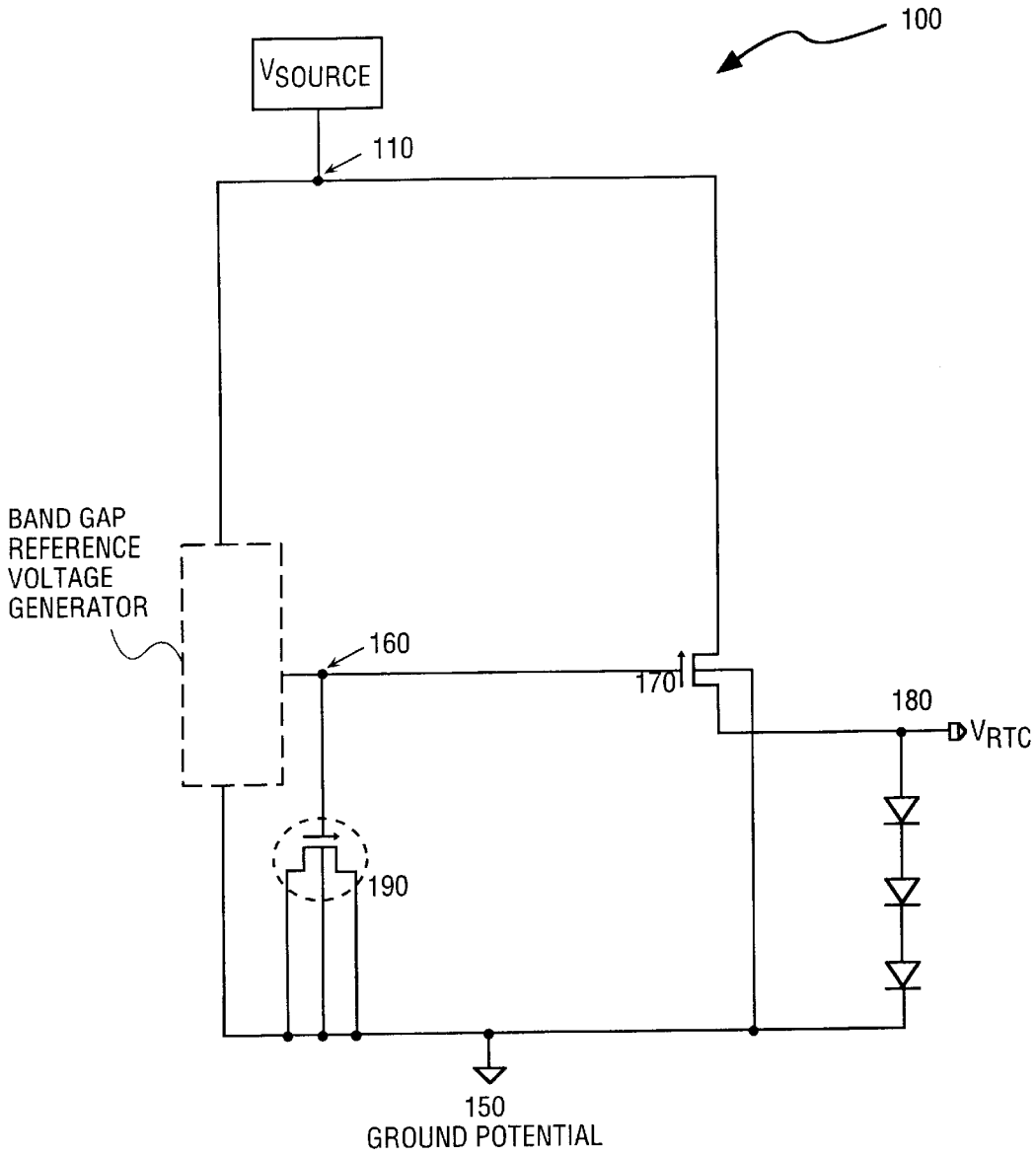
FIG. 6B illustrates a band gap generator in accordance with one embodiment of the invention.

It will be appreciated that in an alternative embodiment to resistor divider 140, diode connected pMOSFETs illustrated in FIG. 5 are preferably used as a voltage reference source. Reversed biased junctions do not occupy much silicon space and provide high resistance to satisfy the current drain to perform an effective job of establishing $V_{DIV}$ at the output of node 160. Reversed biased junctions are formed by a diode connected positive-channel metal oxide semiconductor ("PMOS") transistor with the PMOS transistor having a gate connected to its drain. The implementation of diode connected pMOSFETs is illustrated in FIG. 6A in which divider 310, which comprises four PMOS transistors (320, 330, 340, and 350), replaces resistor divider 140 located in FIG. 1. In another embodiment, a band gap reference voltage generator shown in FIG. 6B may be used in place of resistor divider 140.

While circuit 100 may include a voltage reference source, a voltage reference source is unable to stabilize circuit 100 if circuit 100 is to be included monolithically on the same silicon chip that requires the reduced voltage. Circuit 100, when it is on the same silicon chip, is subjected to the noise or power supply perturbation that could result from other unrelated circuits (i.e., switching, turn on/turn off, etc.). In order to filter or stabilize the voltage at node 160, a transistor is added that is connected as capacitor 190. This is referred to as an enhancement capacitor since its gate is charged positively at node 160 causing a channel to be formed in the capacitor element.

Although circuit 100 in FIG. 1 reduces the battery voltage to a safe voltage level, the power source such as a battery is still disadvantaged since there is electrical consumption of the chemicals in the battery due to the direct current ("DC") load that monitoring circuit 295 (shown in FIG. 3), first resistor 120, and second resistor 130 represent. To achieve an optimum voltage in which a lower voltage from a battery is obtained with less chemicals electrically consumed, inverter 270 is coupled to a circuit to monitor the voltage outputted from the battery as shown in FIG. 3. Inverter 270 is then configured to disable circuit 100 and enable circuit 400 of FIG. 3 when the battery voltage is depleted to a certain range. Circuit 400 regulates the voltage from a power source such that the chemicals in the power source have an extended life beyond that which results when circuit 100 is active.

Inverter 270 is formed by second transistor 200, third transistor 210, and junctions for P-type semiconductor material and N-type semiconductor material ("PN junctions") (220, 230, and 240). The second transistor may be a PMOS transistor whereas third transistor 210 may be an NMOS transistor. When the chemicals in the battery become depleted the battery voltage decreases, and the voltage available from $V_{SOURCE}$ is reduced such that PN junctions (220, 230, and 240) of FIGS. 1 and 3 are no longer forward biased. PN junctions (220, 230, and 240) are forward biased as long as $V_{SOURCE} \geqq 3x$ forward voltage potential ("$V_{FORWARD}$") of the PN junctions (220, 230, and 240). Forward biased occurs when a PN junction has a positive voltage applied to its anode (P-doped semiconductor material) relative to its cathode (N-doped semiconductor material). The current then flows from $V_{SOURCE}$ at node 110 to ground potential voltage at node 150 in which the voltage at node 250 is approximately three times $V_{FORWARD}$.

In comparison, as the chemicals from the battery are depleted, the output voltage drops from>2.0 volts down to about three times the $V_{FORWARD}$ of PN junctions (220, 230, and 240). When the battery voltage drops to approximately three times $V_{FORWARD}$ at $V_{SOURCE}$ at node 110, inverter 270 disables circuit 100 in FIG. 1 and enables circuit 400 of FIG. 3, which results in $V_{RTC}$ appearing at node 180. $V_{RTC}$ at node 180 is restored to a level higher than $V_{160}-V_{t170}$ or $V_{SOURCE}-V_{t290}$~2.0 volts which is approximately the voltage outputted from a source such as a battery minus a single NMOS transistor threshold voltage. $V_{t290}$ represents the threshold voltage for NMOS transistor 290. $V_{160}$ is the voltage at node 160. When $V_{SOURCE}$ falls below approximately three times $V_{FORWARD}$ of a silicon junction, the diode stack formed by PN junctions (220, 230, and 240) is no longer forward biased. Node 250 then is charged through resistor 260 to approximately $V_{SOURCE}$ at node 110. More specifically, node 250 is isolated from node 150 by reversed biased diodes that have virtually zero current flow. As a result, the battery voltage bypasses circuit 100 of FIG. 1 and is connected through PMOS transistor 280 and NMOS transistor 290 to node 180.

At node 180, the voltage continues to decrease as the chemicals in the battery become spent until $V_{SOURCE}$ at node 110 reaches its useful minimum voltage level. A battery is considered to be at the end of its useful life when $V_{RTC}$ at node 180 is equivalent to 900 millivolts which corresponds to a $V_{SOURCE}$ of approximately 0.9 volts plus $V_{t290}$ or about 1.3 volts.

Figure 4:
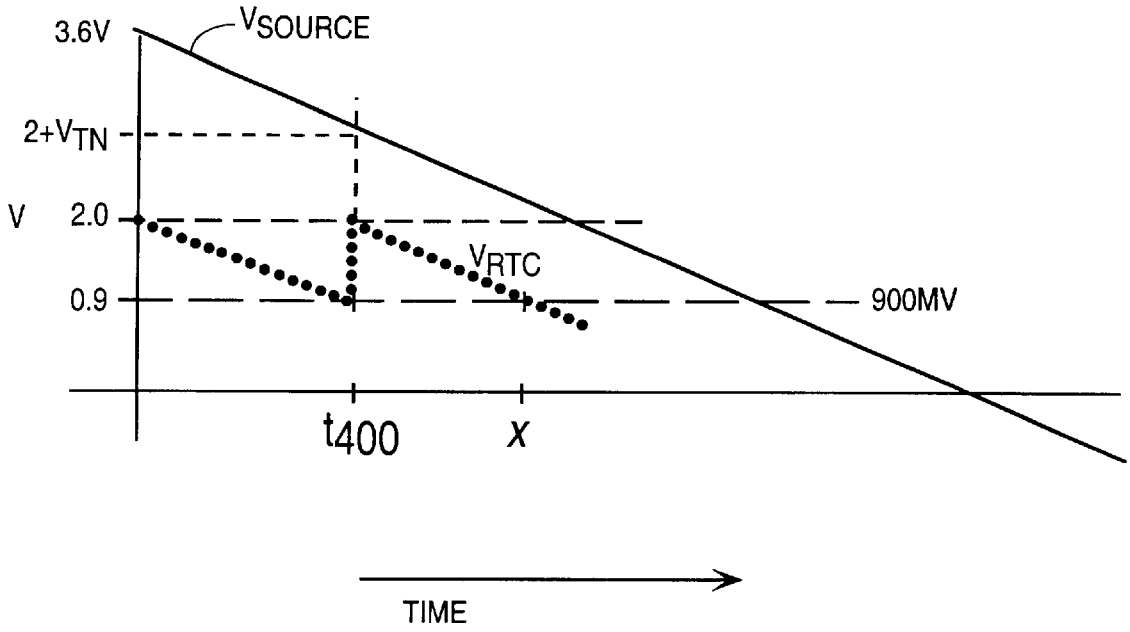
FIG. 4 illustrates the source voltage versus time in accordance with one embodiment of the invention.

Without using inverter 270 of FIG. 3 and the alternate bypass approach described below, the battery would appear to be depleted much sooner at time $t_{400}$ as illustrated in FIG. 4. Approximately two to three years of additional life of the battery is achieved by using the bypass path in which circuit 100 of FIG. 1 is disabled at $t_{400}$. Time period represented by $t_{400}$+x represents the additional life gained through circuit 400. $V_{tn}$ in FIG. 4 represents the threshold voltage for an NMOS transistor which is usually in the range of 0.3 volts to 1.0 volts. This is in contrast to a PMOS transistor that has a threshold voltage in the range of −0.3 volts to −1.0 volts. Circuit 100 is disabled when $V_{SOURCE}$ has a voltage drop to approximately 2 volts+$V_{tn}$.

Figure 9A:
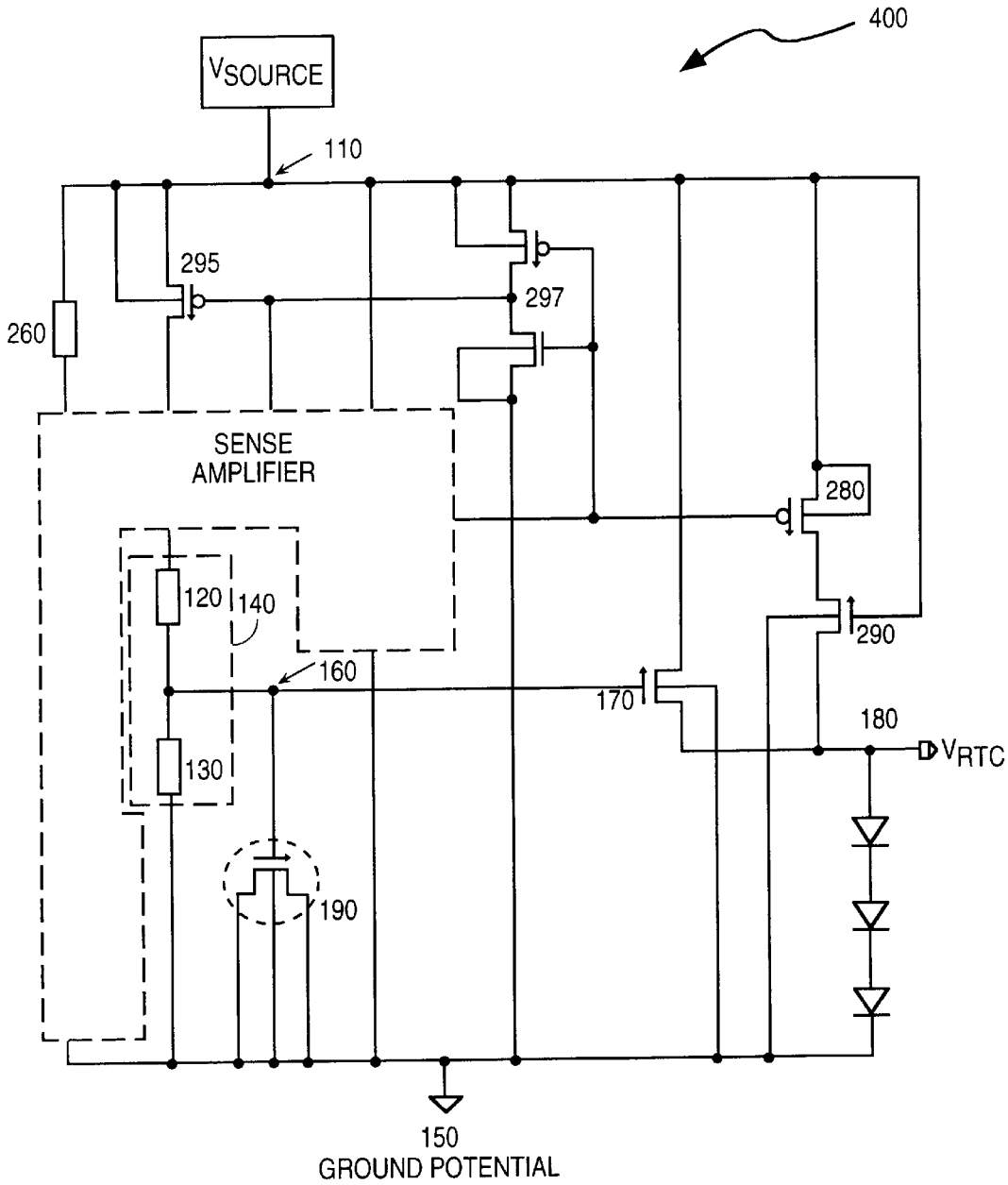
FIG. 9A illustrates a sense amplifier in accordance with one embodiment of the invention.
Figure 9B:
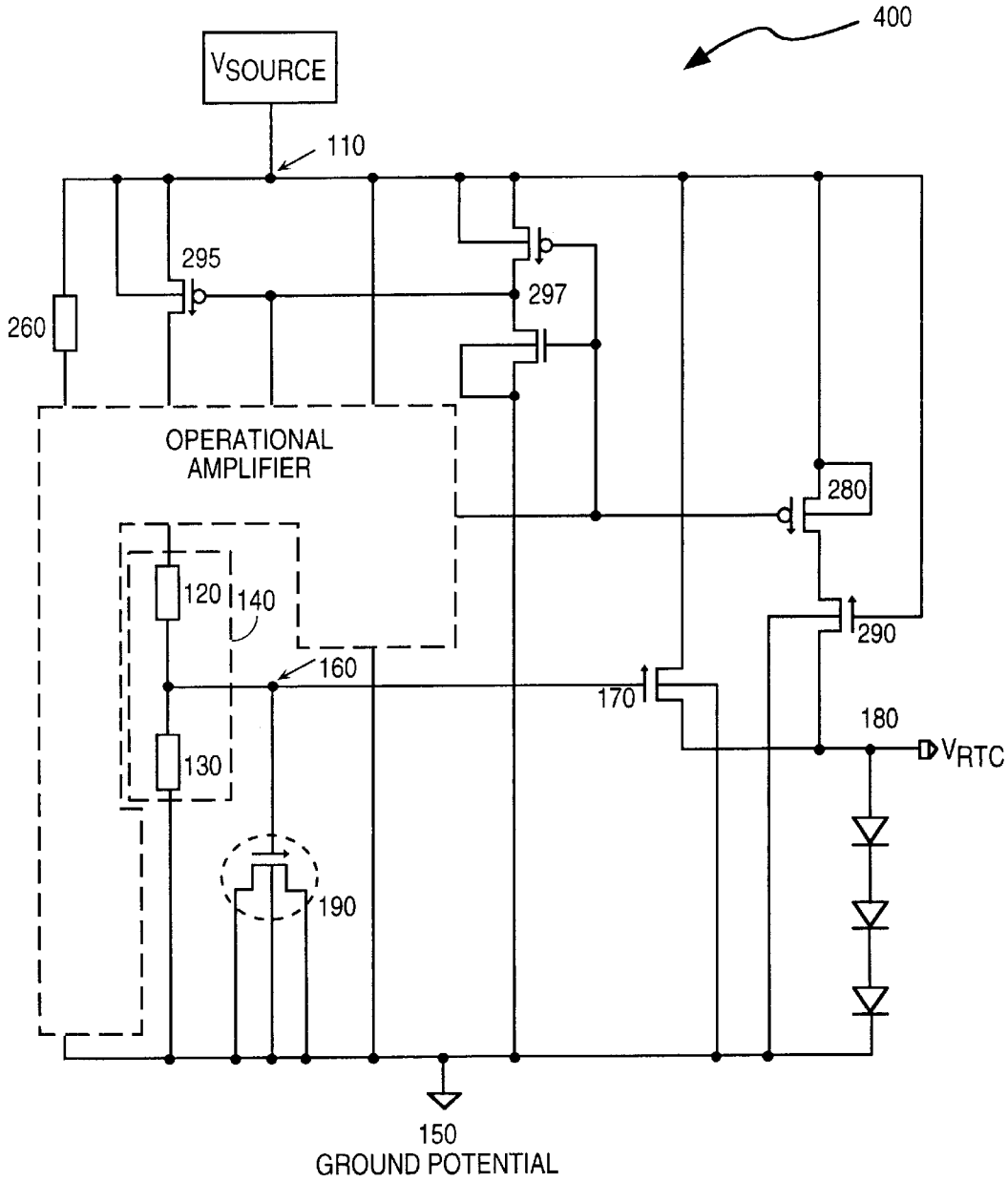
FIG. 9B illustrates an operational amplifier in accordance with one embodiment of the invention.

Given the description of the manner in which the circuit 100 of FIG. 1 is disabled and circuit 400 of FIG. 3 is enabled, the alternate path of circuit 400 is presented. Monitoring circuit 295, which is formed by inverter 270, enables the alternate path of circuit 400 and disables circuit 100 at the same time. This means that monitoring circuit 295 turns on bypass PMOS transistor 280 and connects the $V_{SOURCE}$ through NMOS transistor 290 to the output. Inverter 270 may be formed by a skewed inverter, a sense amplifier shown in FIG. 9A, operational amplifier shown in FIG. 9B, or any other like voltage sensing device.

It will be appreciated by one skilled in the art that either the PMOS transistor of monitoring circuit 295 or PMOS transistor 280 may be used at one time since only circuit 100 of FIG. 1 or circuit 400 of FIG. 3 is enabled at one time. When the gate of PMOS transistor 280 is discharged causing the PMOS transistor 280 to conduct the same potential charge that is discharging, the gate of PMOS transistor 280 is also discharging the input to inverter 297. The output of inverter 297 then goes high (e.g. $V_{SOURCE}$) which is approximately the voltage at node 110 and charges the gate of PMOS transistor of monitoring circuit 295. This eliminates the current path through the voltage reference source such as resistor divider 140 wherein the direct current ("DC") path is cut off by the PMOS transistor of monitoring circuit 295 being turned off. Therefore, either the alternate path shown in FIG. 3 or the subtractor path illustrated in FIG. 1 may be used at one time.

Figure 7:
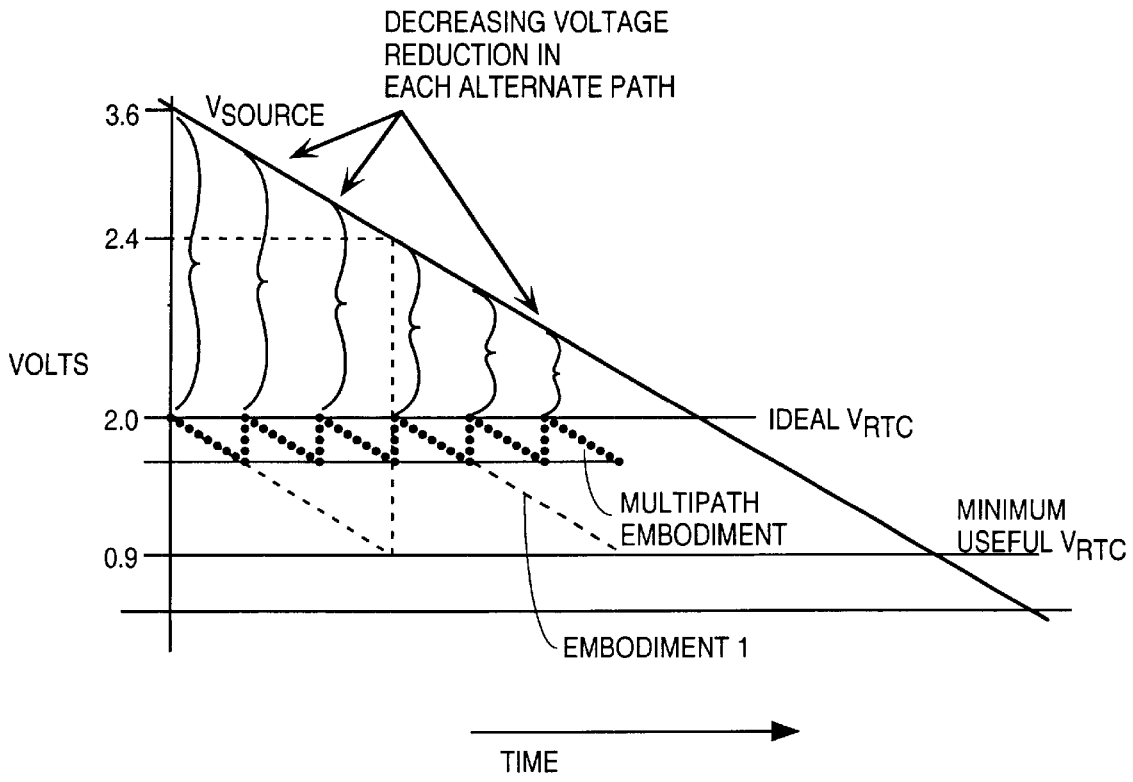
FIG. 7 illustrates the threshold voltage in accordance with one embodiment of the invention.

In another embodiment, multiple inverters connected in parallel in place of single inverter 297 and multiple monitoring circuits connected in series in place of monitoring circuit 295 may be used to provide multiple alternate paths. For example, one alternate path may be represented by a high voltage alternate path (e.g., 400 mV reduction of voltage) and a second alternate path which has a medium voltage (e.g., 200 mV reduction of voltage). Essentially, there are infinite number of implementing techniques of the invention. Multiple monitoring circuits with a predefined switch point may be used to achieve a $V_{RTC}$ that more closely matches the 2.0 volts DC supply ideal as illustrated in FIG. 7. In contrast, circuit 100 of FIG. 1 and circuit 400 of FIG. 3 has approximately 1.6 volts reduction and 0.4 volts reduction, respectively.

Figure 8:
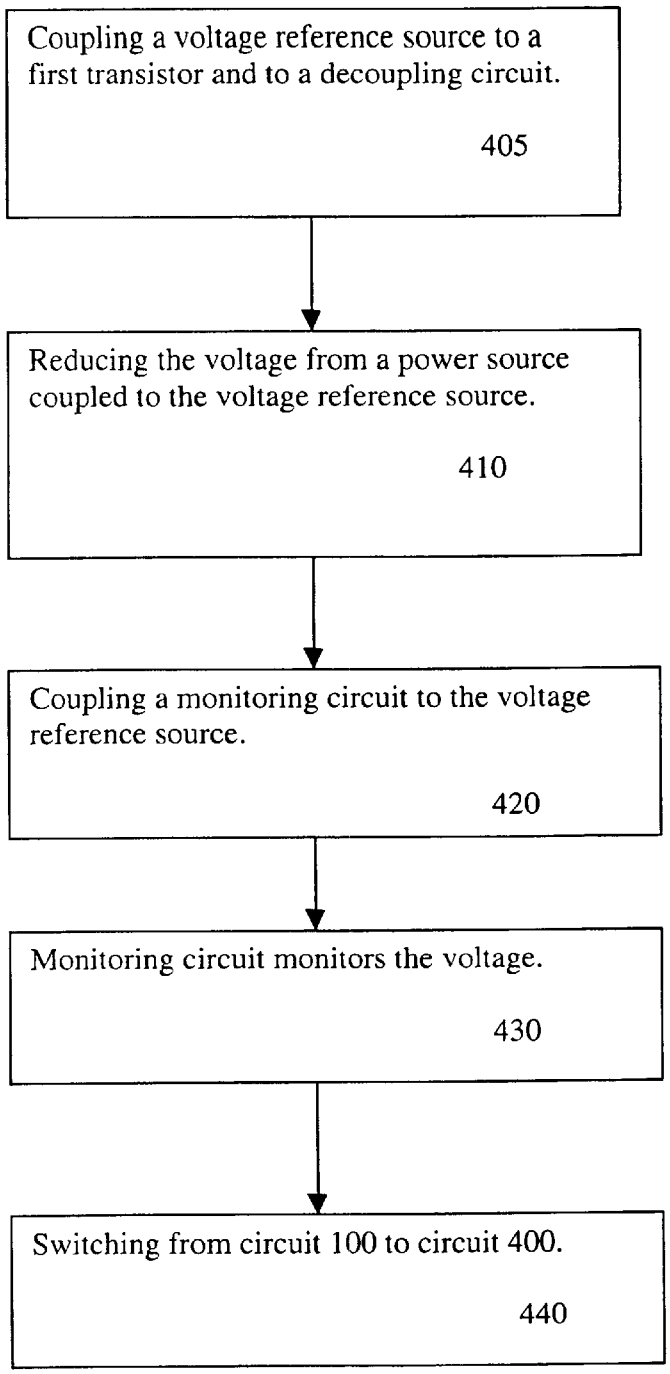
FIG. 8 illustrates a flow diagram in accordance with one embodiment of the invention.

FIG. 8 illustrates a flow diagram in accordance with one embodiment of the invention. At block 405, a voltage reference source such as a resistor divider, reversed bias junction, or a band gap generator is coupled to a first transistor and to a decoupling circuit. At block 410, the voltage from a power source such as a battery coupled to a voltage reference source causes the voltage to be reduced. At block 420, a monitoring circuit is coupled to the voltage reference source. At block 430, the monitoring circuit monitors the voltage from the voltage source. At block 440, the monitoring circuit switches from circuit 100 to an alternate circuit such as circuit 400 when the voltage at node 250 drops to approximately three times $V_{FORWARD}$ at $V_{SOURCE}$ at node 110. More specifically, the circuit such as in FIG. 1 is disabled and the alternate circuit as in FIG. 3 is enabled.

In the preceding detailed description, the invention is described with reference to specific embodiments thereof. It will, however, be evident that various modifications and changes may be made thereto without departing from the broader spirit and scope of the invention as set forth in the claims. The specification and drawings are, accordingly, to be regarded in an illustrative rather than a restrictive sense.

What is claimed is:

1. A circuit comprising:

a voltage reference circuit coupled to a first transistor and to a decoupling capacitor to decrease voltage from a source and to form a first circuit;

the first transistor is a NMOS transistor which has an output voltage equal to a gate source voltage of the NMOS transistor minus an NMOS transistor threshold voltage; and a voltage monitoring circuit, coupled to the source, configured to disable the first circuit and enable a second circuit when the voltage from the source drops from greater than 2 volts, the second circuit configured to reduce depletion of chemicals from the source.

2. The circuit of claim 1, wherein the voltage reference circuit is selected from the group consisting of a resistor divider, a reversed biased junction, and a band gap generator.

3. The circuit of claim 2, wherein the voltage reference circuit comprises a resistor divider, wherein the resistor divider comprises a first resistor and a second resistor.

4. The circuit of claim 3, wherein a divider voltage is set by a ratio of a resistance from the first resistor and a resistance from the second resistor.

5. The circuit of claim 3, wherein the first resistor and the second resistor are configured such that the ratio of the first resistor to the second resistor is approximately fixed.

6. The circuit of claim 1, wherein the threshold voltage is equal to zero.

7. The circuit of claim 1, wherein the voltage reference circuit establishes a reference voltage which is between the source voltage and ground potential.

8. The circuit of claim 3, wherein one of the first resistor and the second resistor comprise a material selected from the group consisting essentially of unsalicided polysilicon, N+ diffusion, P+ diffusion, and N-well diffusion.

9. The circuit of claim 1, wherein the decoupling capacitor performs high pass filtering.

10. The circuit of claim 1, wherein the voltage monitoring circuit comprises a second transistor and a third transistor.

11. The circuit of claim 10, wherein the second transistor is a PMOS transistor and the third transistor is an NMOS transistor.

12. The circuit of claim 11, wherein the PMOS transistor and the NMOS transistor forms an inverter.

13. The circuit of claim 12, wherein the inverter is set at a switching point which is sensitized to a voltage level.

14. The circuit of claim 1, wherein the voltage monitoring circuit is selected from the group consisting of a skewed inverter, a sense amplifier, and an operational amplifier.

15. A method comprising:

coupling a voltage reference circuit to a first transistor and to a decoupling circuit to form a first circuit, wherein the first transistor is an NMOS transistor which has an output voltage equal to a gate source voltage of the NMOS transistor minus an NMOS transistor threshold voltage;

reducing the voltage from a source coupled to the voltage reference circuit; and coupling the voltage reference circuit to a voltage monitoring circuit which is configured to disable the first circuit and enable a second circuit when the voltage from the source drops from greater than 2 volts, the second circuit configured to reduce depletion of chemicals from the source.

16. The method of claim 15, wherein the monitoring circuit comprises at least one of a skewed inverter, a sense amplifier, and an operational amplifier.

17. The method of claim 15, wherein the voltage reference circuit comprises at least one of a resistor divider, a reversed biased junction, and a band gap reference voltage generator.

18. The method of claim 15, wherein the monitoring circuit comprises at least one of a second transistor and a third transistor.

19. The method of claim 17, wherein the resistor divider comprises a first resistor and a second resistor.

20. The method of claim 15, wherein the threshold voltage is equal to zero.

21. A circuit providing a voltage level shifter comprising:

a voltage reference circuit coupled to a transistor and to a decoupling capacitor to form a first circuit so as to decrease voltage from a source, the first transistor is an NMOS transistor which has an output voltage equal to a gate source voltage of the NMOS transistor minus an NMOS transistor threshold voltage;

the voltage reference circuit including at least one of a resistor divider, a reversed bias junction, and a band gap generator; and a voltage monitoring circuit, coupled to the voltage reference circuit, configured to disable the first circuit and enable a second circuit when the voltage from the source drops from greater than 2 volts, the second circuit configured to reduce depletion of chemicals from the source.

22. The circuit of claim 21, wherein the voltage reference circuit comprises a resistor divider, wherein the resistor divider comprises a first resistor and a second resistor.

23. The circuit of claim 22, wherein a divider voltage is set by a ratio of a resistance from the first resistor and a resistance from the second resistor.

24. The circuit of claim 22, wherein the first resistor and the second resistor are configured such that the ratio of the first resistor to the second resistor is approximately fixed.

25. The circuit of claim 21, wherein the transistor is an NMOS transistor.

26. The circuit of claim 21, wherein the threshold voltage is equal to zero.

27. The circuit of claim 22, wherein one of the first resistor and the second resistor comprise a material selected from the group consisting essentially of unsalicided polysilicon, N+ diffusion, P+ diffusion, N-well diffusion.

* * * * *